US008407875B2

(12) United States Patent
Gray et al.

(10) Patent No.: US 8,407,875 B2
(45) Date of Patent: Apr. 2, 2013

(54) APPARATUS AND METHOD FOR ATTACHING FENCING MATERIAL

(76) Inventors: Bryce N. Gray, Meridian, ID (US); Dennis L. Wheeler, Lindon, UT (US); Vance T. Countryman, Hudson, WY (US); Paul A. McBride, Port Orchard, WA (US); Russell R. Myers, Provo, UT (US); Cody S. Curtis, Meridian, ID (US); David W. Allan, Liberty Township, OH (US); Ryan A. Lingmann, Oregon City, OR (US)

( * ) Notice: Subject to any disclaimer, the term of this patent is extended or adjusted under 35 U.S.C. 154(b) by 928 days.

(21) Appl. No.: 12/424,445

(22) Filed: Apr. 15, 2009

(65) Prior Publication Data

US 2009/0314379 A1 Dec. 24, 2009

Related U.S. Application Data

(62) Division of application No. 11/386,041, filed on Mar. 21, 2006, now abandoned.

(51) Int. Cl.

| | |
|---|---|
| ***B23P 19/04*** | (2006.01) |
| ***B23P 11/00*** | (2006.01) |
| ***B23P 19/00*** | (2006.01) |
| ***B23B 27/14*** | (2006.01) |
| ***H01R 43/042*** | (2006.01) |
| ***H01R 43/033*** | (2006.01) |
| ***B21F 27/00*** | (2006.01) |
| ***E04H 17/02*** | (2006.01) |
| ***B25B 7/12*** | (2006.01) |
| *B21F 1/00* | (2006.01) |

(52) U.S. Cl. ..... 29/268; 29/243.56; 29/280; 29/751; 256/47; 256/58; 72/409.12; 140/123

(58) Field of Classification Search ..... 29/268, 29/243.56, 280, 751; 256/57, 47, 48, 65.03; 72/409.12, 383; 140/123, 154, 106, 57
See application file for complete search history.

(56) References Cited

U.S. PATENT DOCUMENTS

| | | | | | |
|---|---|---|---|---|---|
| 340,311 | A | * | 4/1886 | Hayden | 256/54 |
| 368,459 | A | * | 8/1887 | Clow | 256/45 |
| 749,056 | A | * | 1/1904 | Harris | 256/54 |
| 962,523 | A | | 6/1910 | Perry | |
| 1,214,749 | A | * | 2/1917 | Bruflat | 256/48 |
| 1,454,254 | A | * | 5/1923 | Roney | 256/57 |
| 1,475,273 | A | * | 11/1923 | Bernard | 30/184 |
| RE15,878 | E | * | 7/1924 | Stefan, Jr. | 256/48 |
| 1,537,129 | A | * | 5/1925 | Meaker | 256/57 |
| 1,712,752 | A | * | 5/1929 | Dandliker | 256/57 |
| 1,761,452 | A | * | 6/1930 | Paque | 256/57 |
| 1,809,386 | A | * | 6/1931 | Mason | 29/243.56 |
| 1,814,228 | A | * | 7/1931 | Peters | 256/57 |
| 1,848,515 | A | * | 3/1932 | Davidson | 256/57 |
| 1,849,410 | A | * | 3/1932 | Selquist | 204/196.21 |
| 1,868,557 | A | * | 7/1932 | Williams | 256/57 |

(Continued)

*Primary Examiner* — Lee D Wilson
*Assistant Examiner* — Alvin Grant
(74) *Attorney, Agent, or Firm* — Todd E. Zenger; Kirton McConkie

(57) ABSTRACT

A tool for fastening fencing material to a post with a staple. The tool includes a base plate; first and second handles; first and second crimping arms, and a cam operatively engaged with the first handle. A slide is operatively engaged with the cam. The first and second handles and the first and second crimping arms are pivotally interconnected and attached to the base plate so that when the first and second handles are pivoted towards one another from an open position, the cam advances the slide, which advances the staple so that the crimping arms may crimp the staple to the fence post. A method for attaching the staple to a fence post is also described and claimed. An inventive staple is also disclosed.

14 Claims, 17 Drawing Sheets

U.S. PATENT DOCUMENTS 2,036,140 A * 3/1936 Hansen ..... 29/243.56
2,126,225 A * 8/1938 Simons ..... 29/243.56
2,247,631 A * 7/1941 Gardner ..... 256/57
2,331,252 A * 10/1943 Van Tuyl ..... 493/351
2,359,083 A * 9/1944 Carlson ..... 72/57
2,556,725 A * 6/1951 Hurlbut ..... 72/409.1
2,572,738 A * 10/1951 Lovinggood ..... 72/409.12
2,631,804 A * 3/1953 Uhlhorn ..... 248/218.2
2,684,004 A * 7/1954 Holtzapple ..... 29/751
2,705,432 A * 4/1955 Lazar ..... 81/313
2,722,006 A * 11/1955 Ingram ..... 29/243.56
2,741,147 A 4/1956 Marano
2,952,175 A * 9/1960 Edlen et al. ..... 72/383
3,031,170 A * 4/1962 Ingram ..... 256/57
3,086,208 A 4/1963 Eby
3,089,366 A * 5/1963 Haraden ..... 140/154
3,109,333 A * 11/1963 Anderson ..... 72/402
3,169,750 A * 2/1965 Weed ..... 256/57
3,181,339 A * 5/1965 Esser ..... 72/402
3,205,568 A * 9/1965 Stull ..... 29/280
3,317,652 A 5/1967 Johannessen et al.
3,385,326 A * 5/1968 Easton ..... 140/123
3,394,922 A * 7/1968 Bradbury ..... 256/57
3,507,305 A * 4/1970 Crabb ..... 140/106
3,731,561 A * 5/1973 Mongredien ..... 81/9.42
3,977,653 A * 8/1976 Fingerson et al. ..... 256/10
4,090,390 A * 5/1978 Barinaga ..... 72/409.01
4,275,813 A 6/1981 Noiles
4,433,569 A * 2/1984 Santinelli ..... 72/409.01
4,688,769 A * 8/1987 Smrt ..... 256/65.03
4,718,803 A * 1/1988 Reitze ..... 411/476
4,893,788 A * 1/1990 Chave ..... 256/47
4,917,154 A 4/1990 Roberson, Sr.
4,982,932 A 1/1991 Baker
5,046,705 A 9/1991 Williams
5,222,975 A 6/1993 Crainich
5,350,155 A 9/1994 Burk
5,649,572 A 7/1997 Lile
5,673,838 A * 10/1997 Reitze ..... 227/119
5,975,501 A 11/1999 Berg et al.
6,044,872 A * 4/2000 Stephens ..... 140/57
6,293,521 B1 * 9/2001 Parrish ..... 254/199
6,296,233 B1 10/2001 Bert et al.
6,425,903 B1 7/2002 Voegele
6,499,514 B1 12/2002 Hodge
7,434,440 B2 * 10/2008 Fay ..... 72/409.1
2006/0243340 A1 * 11/2006 Wheeler et al. ..... 140/57

* cited by examiner

APPARATUS AND METHOD FOR ATTACHING FENCING MATERIAL

RELATED APPLICATIONS

This application is a divisional of U.S. application Ser. No. 11/386,041, filed Mar. 21, 2006; which claims priority to U.S. Provisional Application No. 60/664,291, filed Mar. 22, 2005.

BACKGROUND

1. Field of the Invention

This invention relates generally to a tool and connector for attaching fencing material to a post and the methods of using the same. Some embodiments of the invention relate more specifically to a tool and method for attaching fencing material to a generally t-shaped post with an inventive staple.

2. Background of the Invention and Related Art

The use of barbed wire and woven wire fences is common throughout the world. A fence post having a generally T-shaped cross section was developed many years ago to replace the wooden fence post as it is more durable and economical. It is generally known that a T-shaped fence post is constructed to include a plurality of protrusions located on what may be considered the top portion of the T-shape and which are spaced a predetermined distance apart in the vertical direction the length of the post. These protrusions are utilized to prevent wire or other material from slipping downward or upward after fencing has been attached to the post.

The most common application for the T-post is for livestock containment. After the T-posts are driven into the ground, the fencing is stretched from a beginning location to an end location proximate each post. Typically, four or five strands of barbed wire or a woven wire are attached to each post. A common technique for attaching the fencing is to lift the wire or wires by hand into position and hold them in place with one hand while hooking a clip made of preformed wire to the fence wire on one side of the T-post with the other hand. The clip is then swung around the post and with the aid of a tool; the other end of the clip is hooked over the wire. This process is repeated for each wire intersection at each post. Such a clip is manufactured by Chicago Heights Steel of Chicago Heights Ill.

Other methods of attaching the fencing material to the post include wrapping an attachment wire around the post and twisting the attachment wire ends together to secure the fence wire to the post with pre-made wire or wire from a roll of wire. Yet another method of attachment for chain link fence with round posts includes use of a shaped wire formed to surround the post and fencing material. The protruding ends of the shaped wire are then twisted together using a drill attachment. Such a shaped wire and drill attachment are manufactured by Stay-Tite Fence Mfg. Inc. of New Braunfels, Tex.

The methods described above are labor intensive and difficult. The installation is done by hand. The use of available tools still requires positioning and holding the wire to be attached by hand. The installer's safety is of concern as material such as barbed wire must currently be handled directly by hand which can lead to injury. The use of current tools is also cumbersome at best and may not allow for useful access when a woven wire material is used.

All US patents, applications and all other published documents mentioned anywhere in this application are incorporated herein by reference in their entirety.

SUMMARY AND OBJECTS OF THE INVENTION

An embodiment of the invention provides a tool for fastening fencing material to a post with a staple. The tool includes a base plate, first and second handles, first and second crimping arms, and a cam operatively engaged with the first handle. A slide is operatively engaged with the cam. The first and second handles and the first and second crimping arms are pivotally interconnected and attached to the base plate so that when the first and second handles are pivoted towards one another from an open position, the cam advances the slide, which advances the staple so that the crimping arms may crimp the staple to the fence post.

The tool of further comprises a top plate connected to the base plate, the top plate having a first wire positioning member for engaging and positioning the fencing material proximate the post, the first member having a top and a bottom. The base plate includes a second wire positioning member for engaging and positioning the fencing material proximate the post, the second member having a top and a bottom. The fencing material is positioned on the top of the first member and on the bottom of the second member; it can be positioned on the bottom of the first member and on the top of the second member.

The tool includes a staple delivery apparatus, the staple delivery apparatus comprising the slide having a staple receiving end, and a recess for receiving the staple, the slide engaging a staple and advancing the staple into the recess as the cam linearly advances the slide. A top plate is connected to the base plate, the top plate having an aperture proximate the staple receiving end of the slide. A chute is constructed and arranged to receive at least one staple, the chute connected to the top plate and having a top portion and a bottom portion, the bottom portion having a chute aperture, the chute aperture generally aligned with the top plate aperture, wherein when the first and second handles are in an open position the staple is positioned onto the slide plate. The chute holds a plurality of staples. A shuttle is configured and arranged to slide within the chute, the shuttle having a forward and a rear end, wherein the forward end of the shuttle engages the staple. A spring having a first end and a second end is provided, the first end connected to the chute and the second end connected to the shuttle, for applying a force to the staple to hold it in position.

The handles are rotated through a plurality of positions, from the open position to a fully open position, from the fully open position to a crimping position, from a crimping position to a closed position. When the handles are in the fully open position, the slide is retracted behind the staple, the spring forcing the staple downward to the base plate. When the handles are in the crimping position, the slide having advanced the staple into the recess. When the handles are in the closed position, the crimping arms have crimped the staple to the post.

A method for attaching fencing material to a post is also disclosed, the method comprising providing a tool having a base plate; first and second handles; first and second crimping arms; a cam operatively engaged with the first handle; a slide operatively engaged with the cam; the first and second handles and the first and second crimping arms pivotally interconnected and attached to the base plate so that when the first and second handles are pivoted towards one another, the cam advances the slide, which advances the staple so that the crimping arms may crimp the staple to the fence post. The tool also provides first and second wire engaging prongs. The tool is engaged with the wire so that the wire extends over a top surface of the first prong and extends under a bottom surface of the second prong. The tool is advanced so that the wire is in contact with the fence post. The staple is crimped to the fence post by moving the handles towards one another to attach the wire to the fence post.

The method further includes the step of moving the handles from an open position to a fully open position, so that the slide is retracted behind the staple, and the staple is positioned on the base plate. The method further includes the step of moving the handles from the fully open position to a crimping position, so that the slide advances the staple into a recess. The method further includes the step of moving the handles from the crimping position to a closed position, so that the staple is crimped by the crimping arms to the post.

An inventive staple is also described herein, comprising a v-shaped base portion, the v providing a space for a wire of the fencing material, and first and second legs connected to the v-shaped base portion.

These and other embodiments which characterize the invention are pointed out with particularity in the claims annexed hereto and forming a part hereof. However, for additional understanding of the invention, its advantages and objectives obtained by its use, reference should be made to the drawings which form a further part hereof and the accompanying descriptive matter, in which there is illustrated and described embodiments of the invention.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings; Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention is not intended to limit the scope of the invention, as claimed, but is merely representative of the presently preferred embodiments of the invention.

Figure 6:
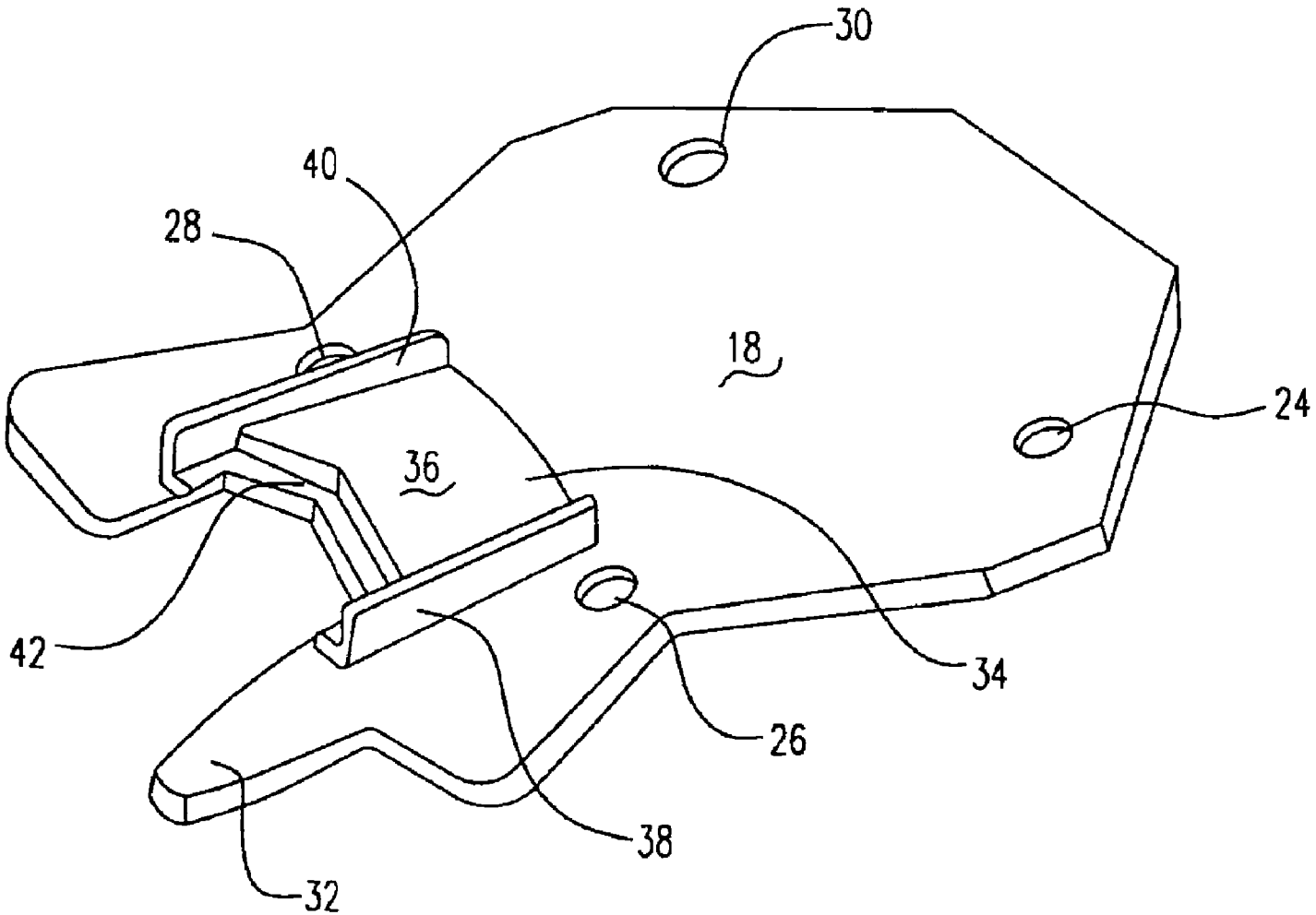
FIGS. 6 through 8 are perspective views of the base plate of the embodiment as shown in FIG. 1 showing the positioning of the staple.
Figure 7:
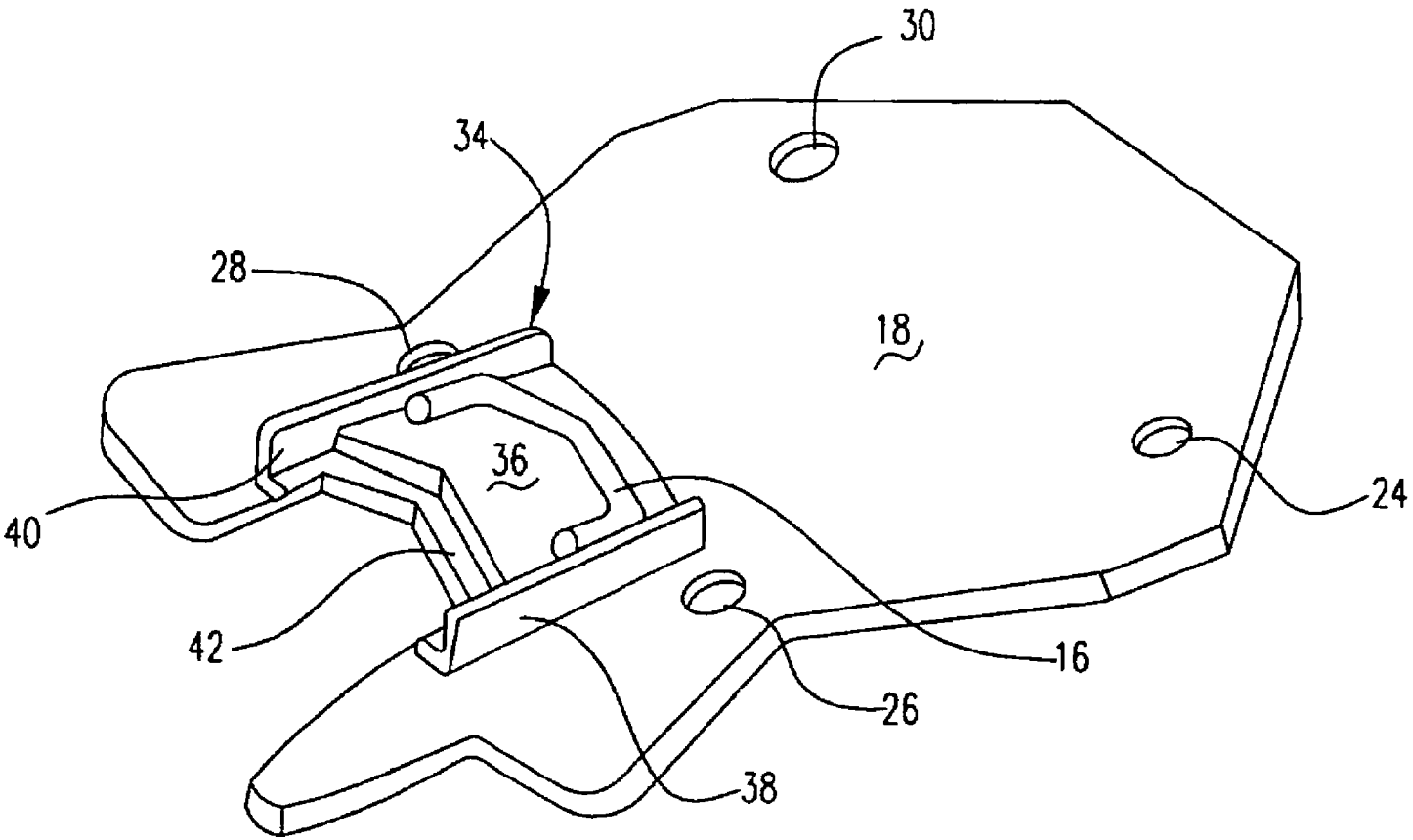
Figure 8:
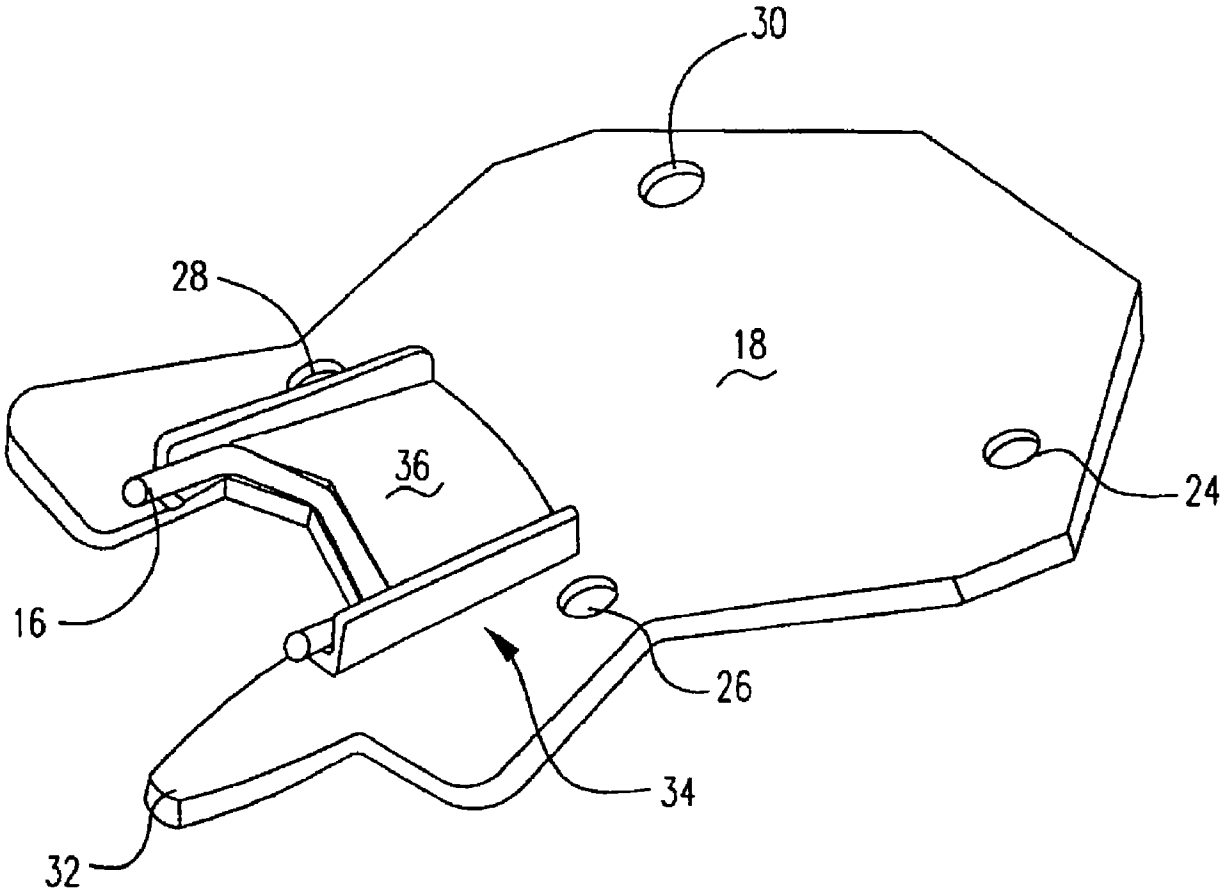
Figure 9:
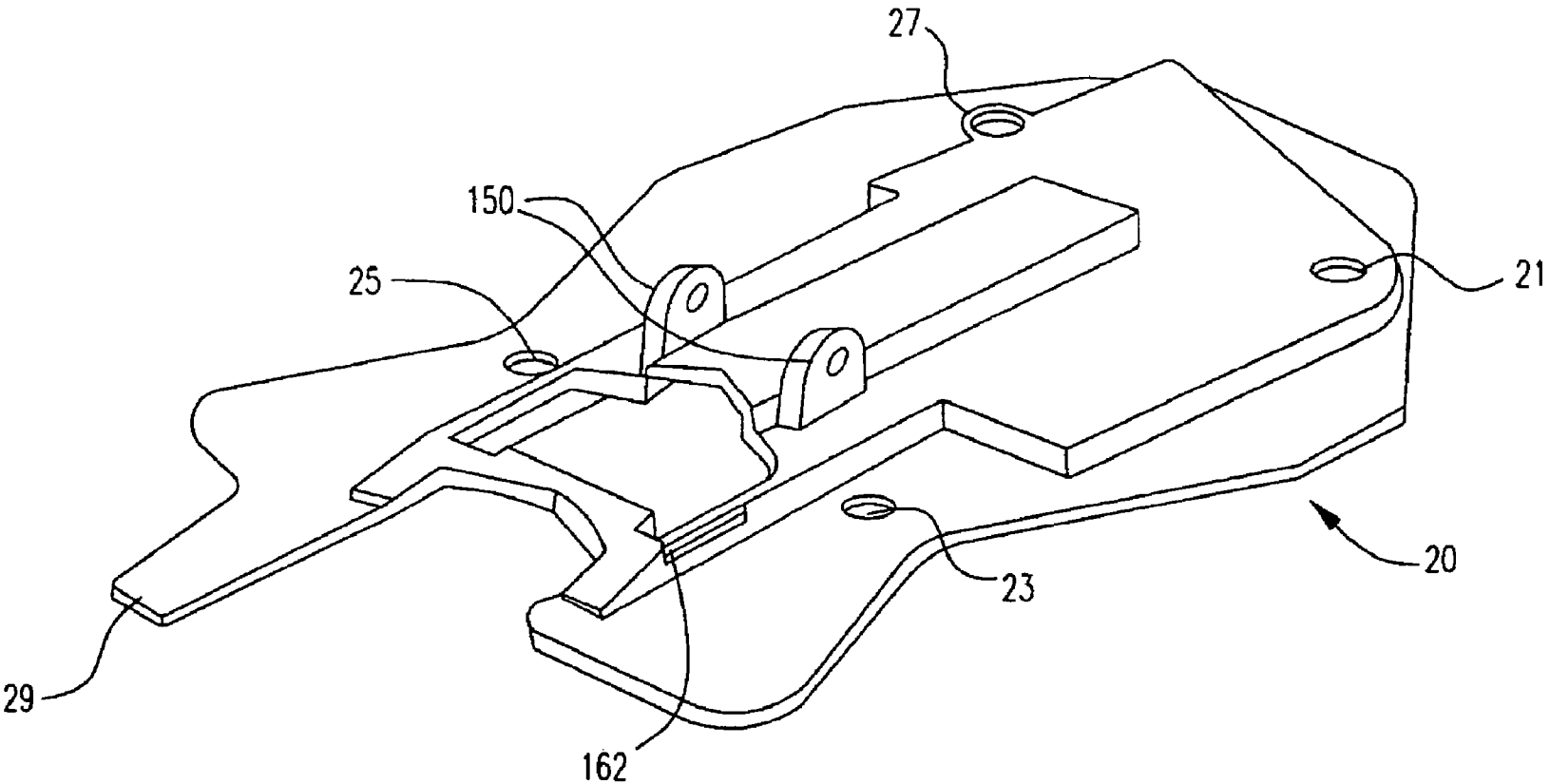
FIG. 9 is a perspective view of the top plate of the embodiment as shown in FIG. 1.

Referring now to FIGS. 1 and 12-14, an embodiment of a fencing tool 10 is shown. The tool 10 is utilized to position a wire 12 at a desired location adjacent a post 14 and then attach the wire using an inventive staple 16. This tool will attach any commercially available fencing material, and wire should be understood as referring to either metal or plastic. The tool 10 includes a base plate 18 (best seen in FIGS. 6-8) and a top plate 20 (best seen in FIG. 9). As shown in FIG. 9, the top plate 20 includes a number of apertures 21, 23, 25, and 27 for pivotally attaching various parts of the tool 10 between the top and base plates 20 and 18, as will be described herein. The top plate 20 includes a first wire lift finger 29 for positioning the wire or other fencing material to be attached. The bottom plate 18 includes a second lift finger 32 for positioning the wire or other fencing material to be attached. It should be understood that the lift fingers could be reversed, or both could be located on one plate or the other. A magazine assembly 22 is connected to the top plate 20 and will be discussed in further detail later in this description.

Referring now to FIGS. 2-5, the embodiment of the fencing tool 10 is shown where the top plate 20 is removed for ease of understanding. The base plate 18 is shown in FIGS. 2-5 as well as FIGS. 6-8. The base plate 18 includes a number of apertures 24, 26, 28 and 30 (best seen in FIG. 6) for mounting various parts of the tool 10 to be described herein. The base plate 18 also includes a second wire lift finger 32 for positioning the wire or fencing material when using the tool. The base plate 18 further includes a staple platform 34. The staple platform 34 includes a base 36, side walls 38 and 40, and a crimp pocket 42. The staple platform 34 is sized and configured to accommodate the desired shape and size of the staple 16.

A first handle 44 includes an aft end 46 and forward end 48. The aft end 46 is gripped by the user. The forward end 48 includes an aperture 50 and a first set of gear teeth 52. A cam assembly 54 is also included. A bushing 60 pivotally connects the handle 44 and cam assembly 54 to the base plate 18 and top plate 20, so that the cam 54 rotates with handle 44. The cam assembly 54 includes an aperture 56 and a slot 58. Aperture 56 is aligned with aperture 50 of the handle 44, aperture 24 of base plate 18, and aperture 21 of the top plate 20. The bushing 60 is constructed and arranged such that it provides the required spacing between the top and base plates for operation as well as providing a means for fastening.

Again, referring to FIGS. 2-5, a second handle 62 is shown and includes an aft end 64 and a forward end 66. The aft end 64 is used as a grip by the user. The forward end 66 includes an aperture 68 and a second set of gear teeth 70 which are constructed and arranged to engage the first set of gear teeth 52. The second handle 62 is pivotally connected to the base plate 18 and top plate 20 with bushing 72. Aperture 68 and aperture 30 of the base plate 18 are aligned with aperture 27 of the top plate 20. The bushing 72 is constructed and arranged such that it provides the required spacing between the plates for operation and fastening.

A first crimp arm 80 is pivotally connected to the base and top plates 18 and 20. The crimp arm 80 includes a third set of gear teeth 82 which are constructed to engage the first set of gear teeth 52 of the first handle 44. The crimp arm 80 has a first crimping jaw 84 for engaging and crimping a staple 16 as desired. The first crimp arm 80 is connected to the base and top plates 18 and 20 by means of a bushing 85 through apertures 23 and 26 of the top and base plates.

A second crimp arm 86 is pivotally connected to the base and top plates 18 and 20. The crimp arm 86 includes a fourth set of gear teeth 88 which are constructed to engage the second set of gear teeth 70 of the second handle 62. The crimp arm 86 has a second crimping jaw 90 for engaging and crimping a staple 16 as desired. The second crimp arm 86 is connected to the base and top plates by means of a bushing 87 through apertures 25 and 28 of the top and base plates.

Figure 17:
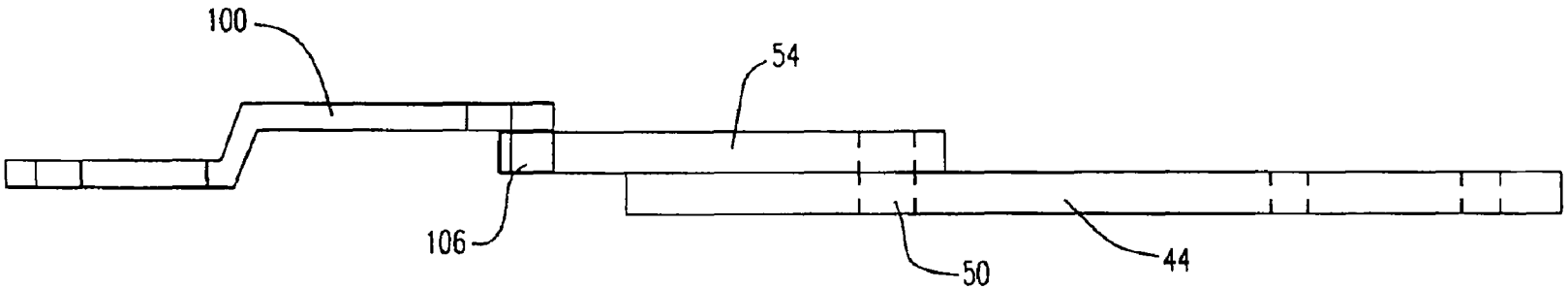
FIG. 17 is a side elevational view showing the handle, cam and slide plate.

Still referring to FIGS. 2-5, an advance slide 100 is shown. The advance slide 100 has a forward end 102 and aft end 104. The aft end 104 includes a pin 106 (best seen in FIG. 17) which is received by the slot 58 of the cam assembly 54. The forward end 102 is slidably received by the staple platform 34. The slide 100 rests on the staple platform base 36 and is guided by the walls 38 and 40. The forward end 102 includes a wall 108 generally shaped to contact at least a portion of the staple 16 and move it along the staple platform base 36 and through guides 38 and 40 to the crimp pocket 42 as the tool 10 is operated.

Figure 1:
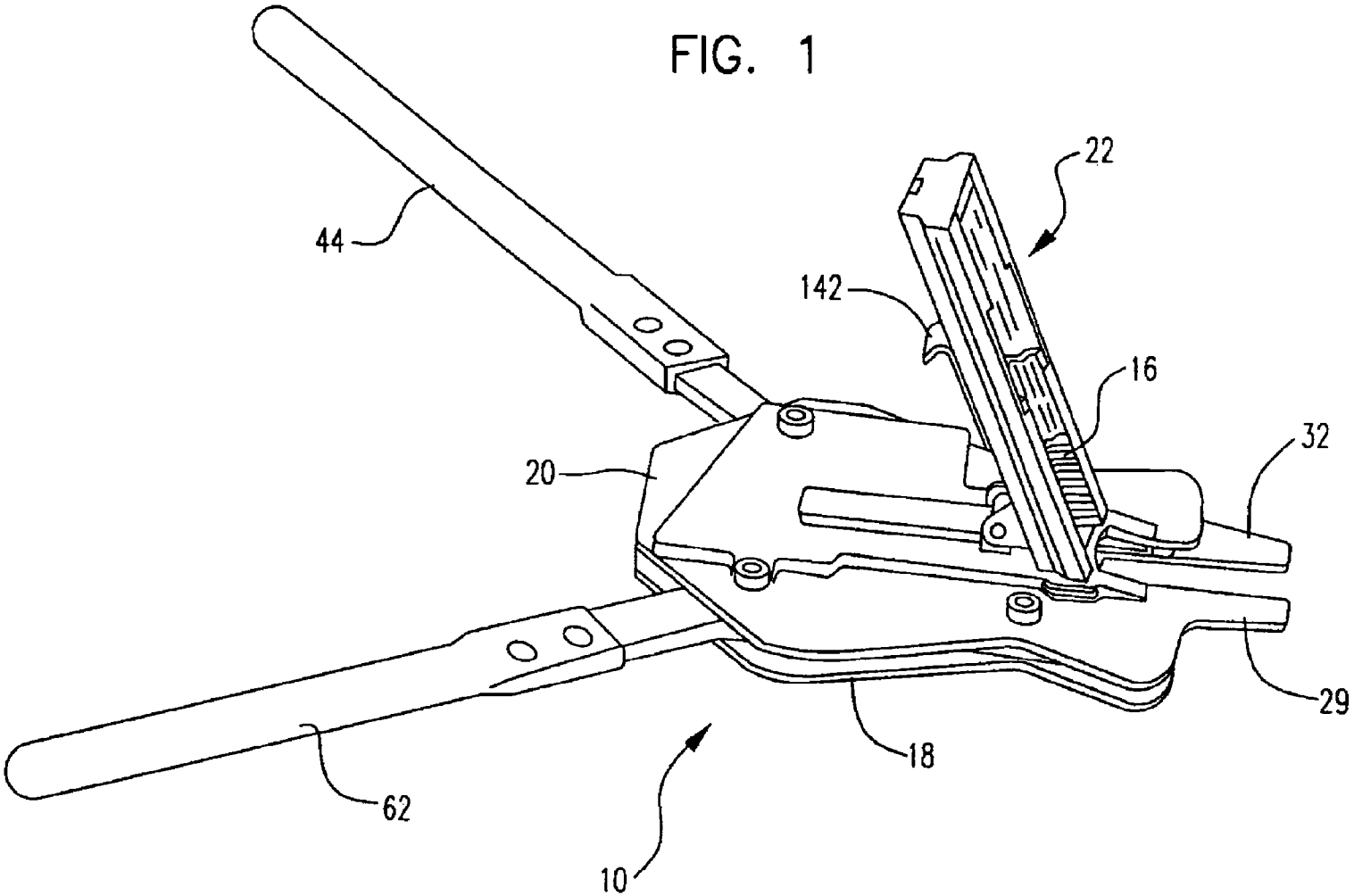
FIG. 1 is a perspective view of an embodiment of the invention comprising the fencing tool.
Figure 2:
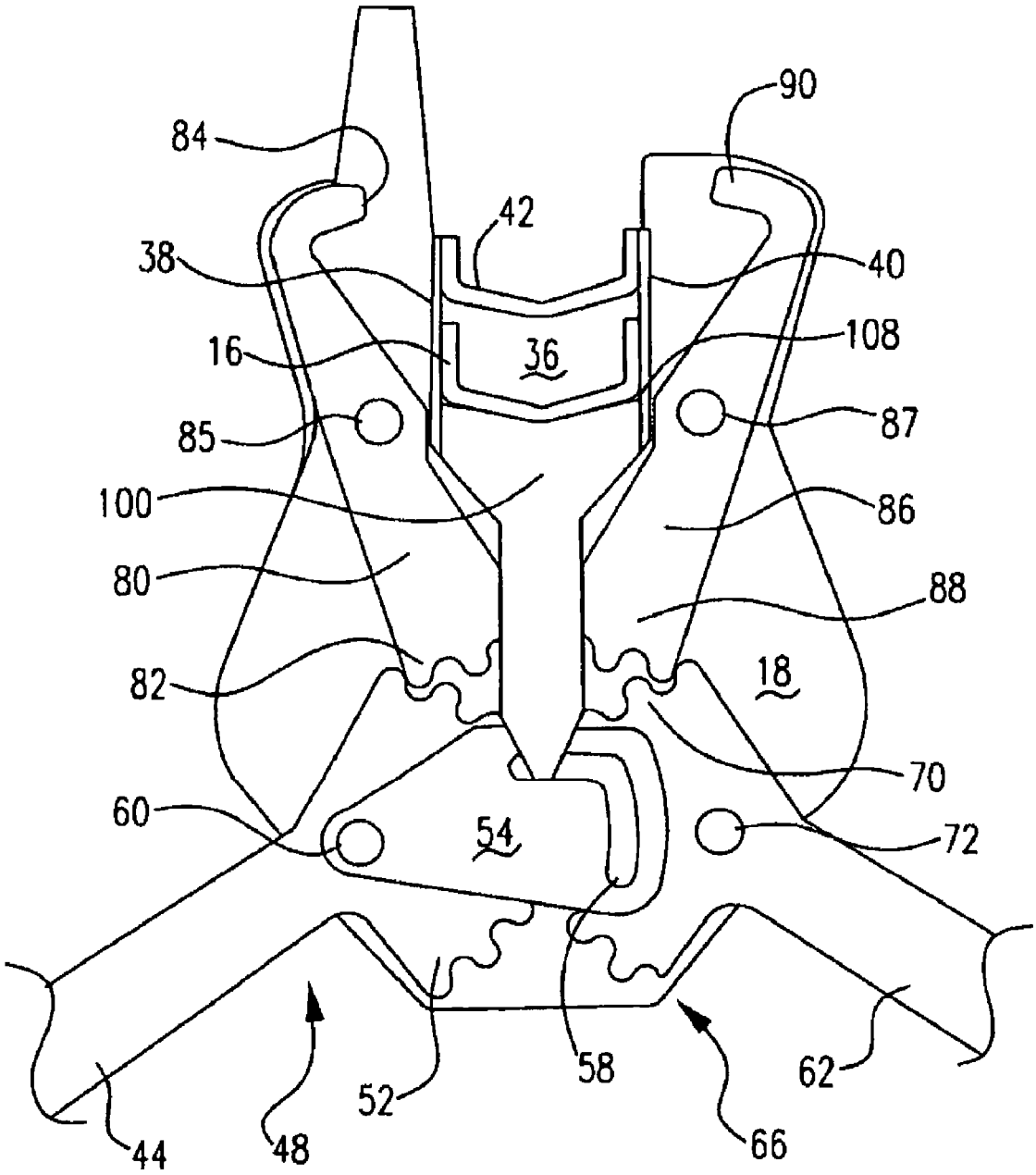
FIGS. 2 through 5 are top elevational views of the embodiment as shown in FIG. 1 without the top plate, illustrating the process of moving and crimping of a staple.
Figure 3:
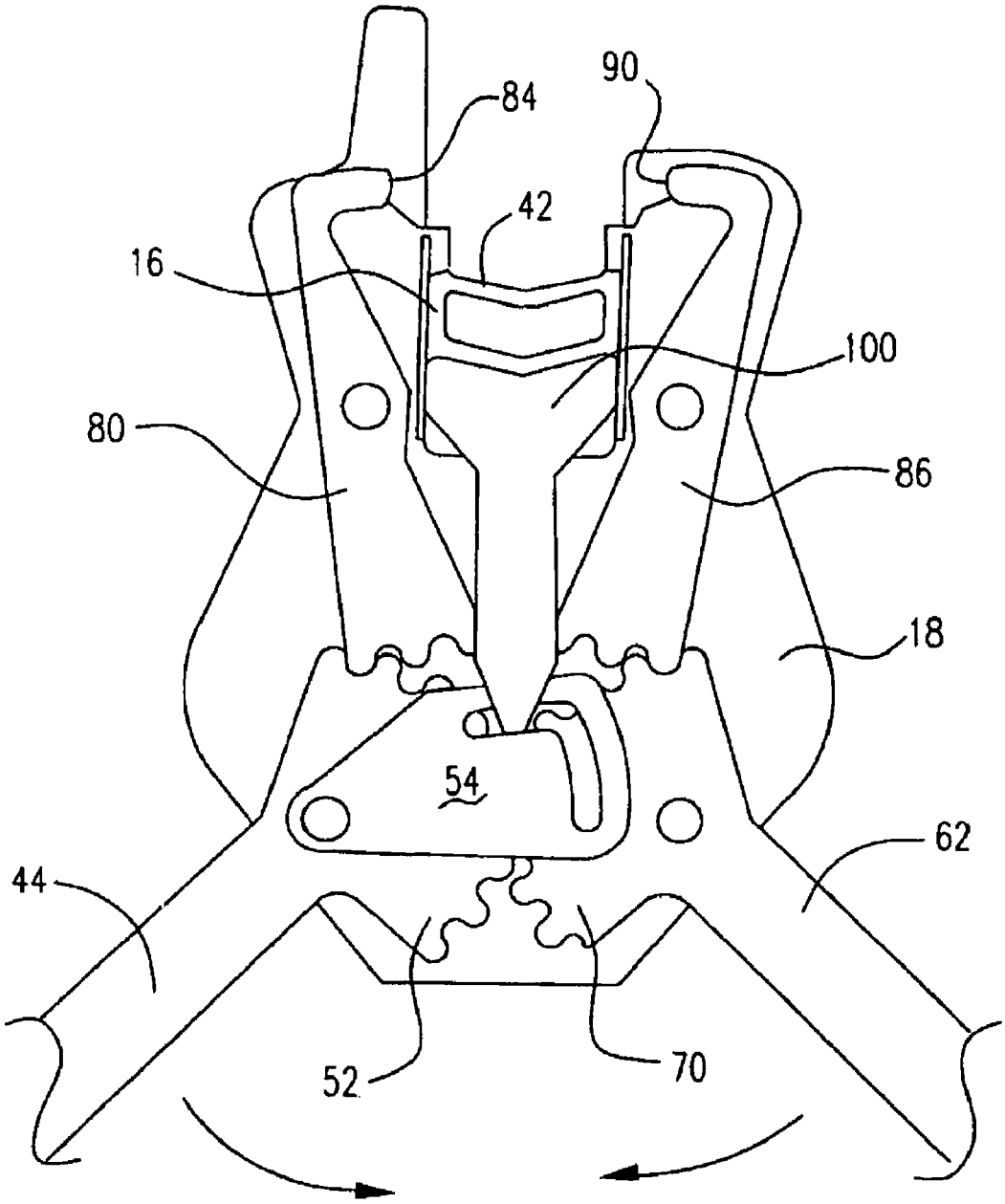

The inter-operation of the handles, cam, crimp arms and advance slide will now be described. A staple 16 rests upon the base 36 of the staple platform 34. When the first and second handles 44 and 62 are fully opened as shown in FIG. 2, the advance slide 100 is moved rearwardly by the cam 54 to a full rearward position. The wall 108 of the advance slide 100 sits rearward of the staple 16 as shown in FIG. 2. The first and second handles 44 and 62 are indexed with opposing gear teeth 52 and 70 for correct timing positions. The gear teeth 82 and 88 of the first and second crimp arms 80 and 86 are indexed with opposing gear teeth 52 and 70 of the first and second handles, respectively. In this manner, the first and second crimp arms 80 and 86 are in their fully opened position when the first and second handles 44 and 62 are in their fully opened position. As the handles 44 and 62 are moved together by the user as seen in FIG. 3, the gear teeth 52 and 70 cooperatively engage, and cam 54 is rotated with the movement of the handle. Pin 106 of advance slide 100 moves within the slot 58 of the cam assembly 54. Therefore, advance slide 100 is moved generally linearly thereby pushing the staple 16 toward the crimp pocket 42. Also, crimp arms 80 and 86 begin to move inward due to the rotation of the handles 44 and 62 and engagement of the gear teeth 52 and 70 with the gear teeth 82 and 88 of the crimp arms 80 and 86.

Figure 4:
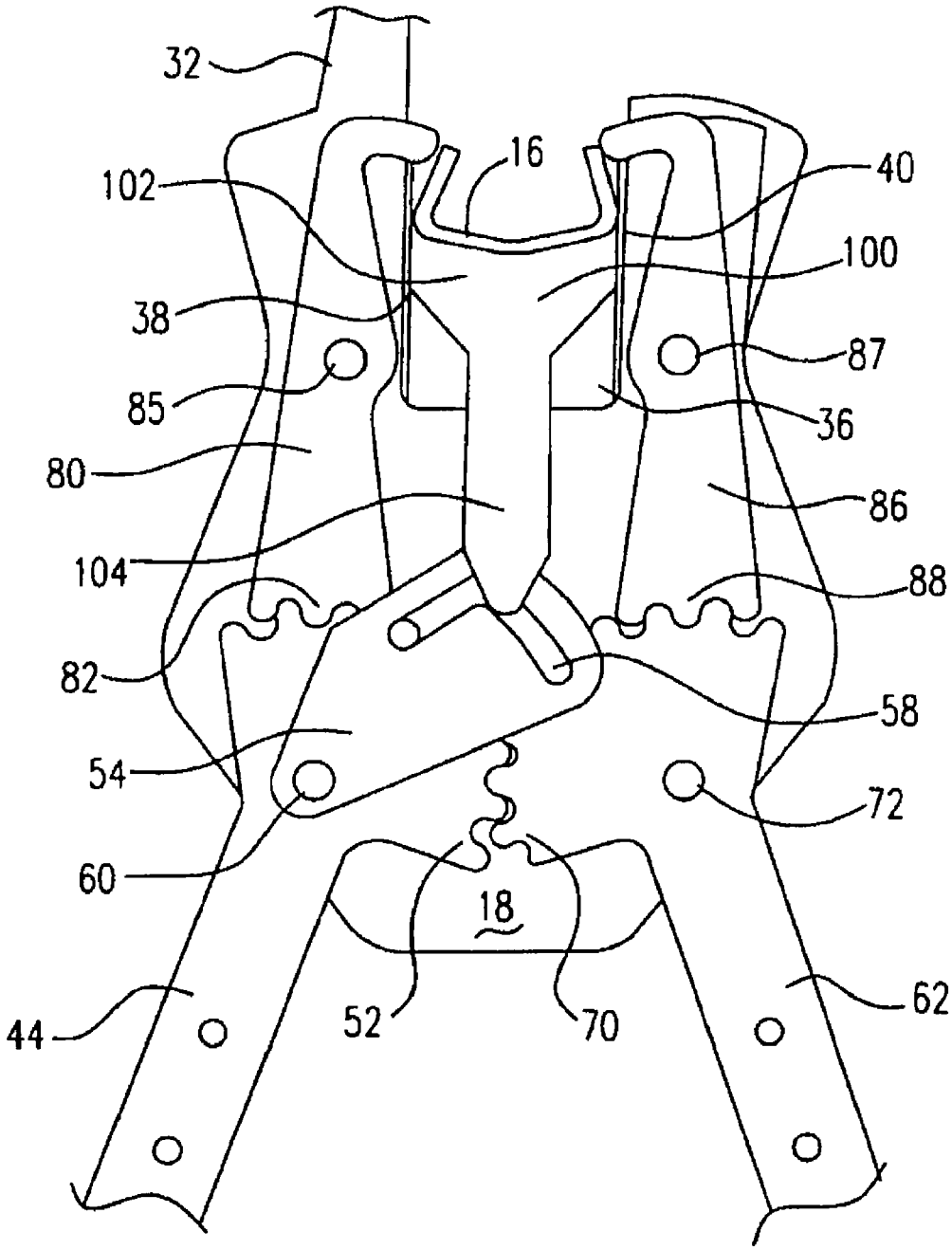
Figure 5:
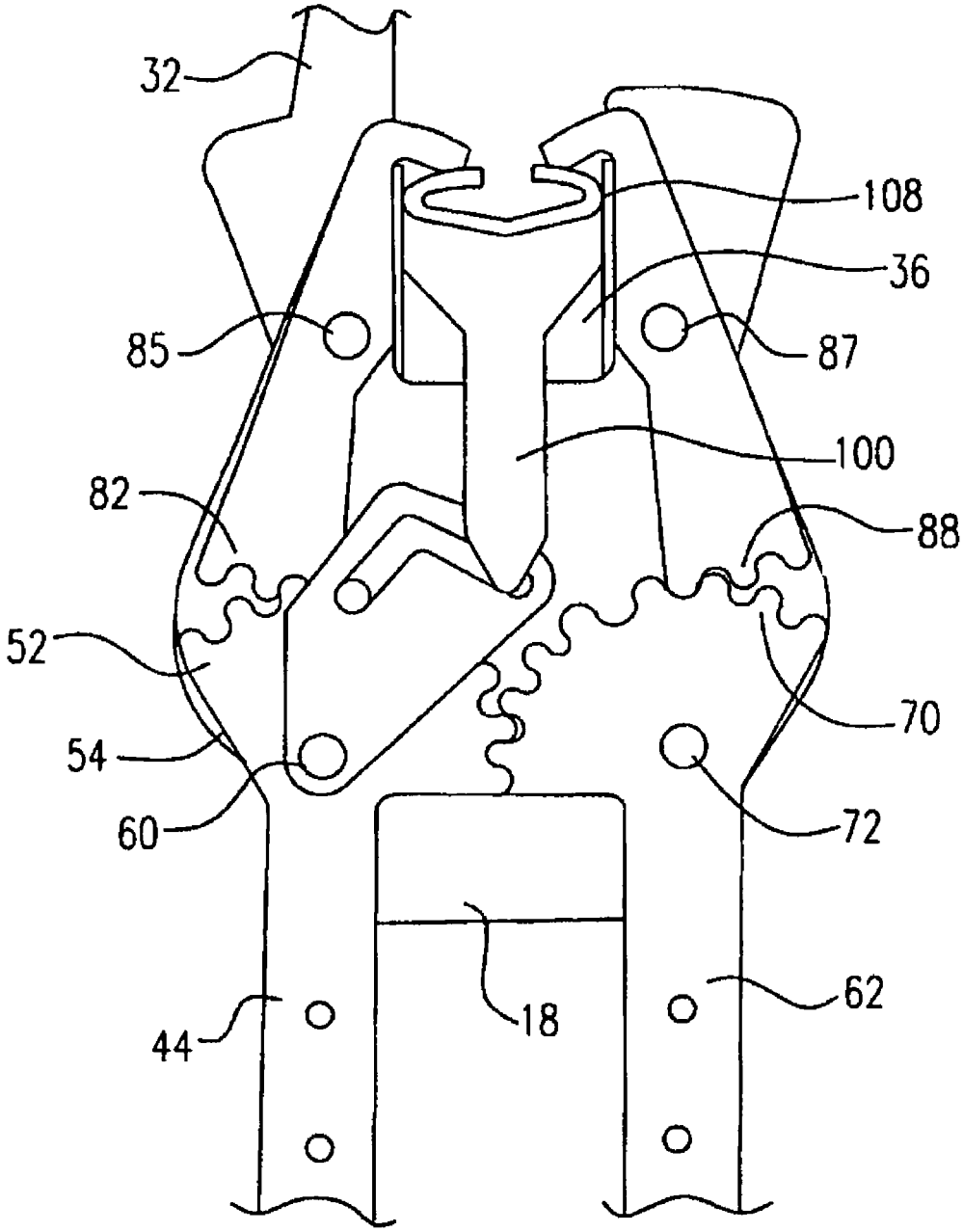

FIG. 4 illustrates further movement of the handles where the staple 16 has been moved to the crimp pocket 42, and the tool is shown in the crimping position. The staple 16 is pushed into the crimp pocket 42 at the end of travel of the advance slide 100. The cam 54 is designed to stop advancement of the slide 100 after the staple 16 is moved to the crimp pocket 42 so that the staple 16 may be attached and crimped to the fence post without interference. The arms 80 and 86 continue to rotate inward with the rotation of the handles 44 and 62 to crimp the staple 16. The crimping jaws 84 and 90 contact the staple 16 and bend it inward as desired. FIG. 5 shows the tool 10 in a closed position after crimping of the staple 16 by the jaws 84 and 90 of the crimp arms 80 and 86. Moving the staple 16 into crimp pocket 42 has the advantage of decreasing the forces that would be acting on the cam, pin, and slide if no pocket is present. Also, the part size and weight of the cam, pin, and slide may be reduced. Further, wear on the pin and slot are reduced. With the use of the pocket, the brunt of the forces created by the crimping action are borne by the base plate of the tool. This embodiment also requires less force by the user to operate the tool through crimping.

Figure 10:
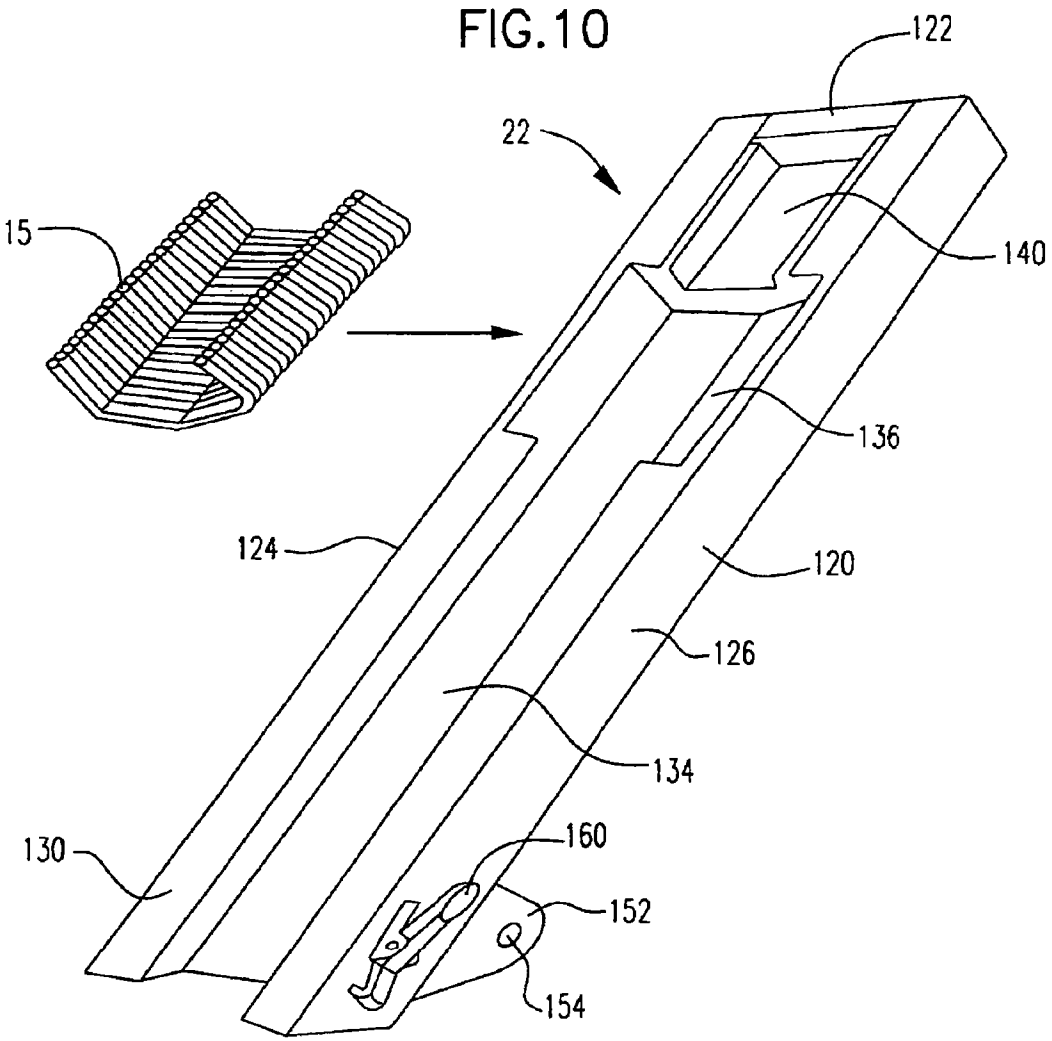
FIG. 10 is a perspective view of the load side of the staple magazine of the embodiment as shown in FIG. 1.
Figure 11:
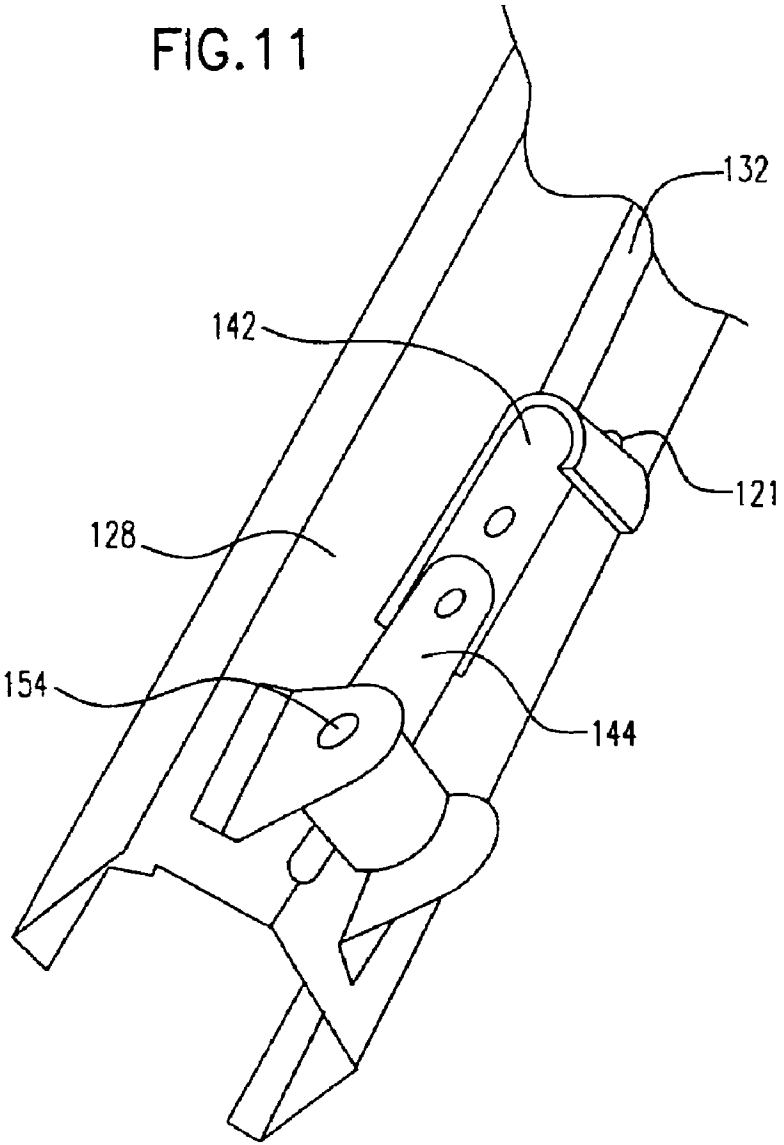
FIG. 11 is a perspective partial view of the rear side of the staple magazine of the embodiment as shown in FIG. 1.

Referring now to FIGS. 10 and 11, a staple magazine 22 is shown. The staple magazine 22 is able to store a plurality of staples 16 and feed the staples one at a time onto the base plate of the tool 10 as demanded by the user. The magazine 22 includes a body 120. The body 120 includes a top plate 122, side walls 124 and 126, a back 128 and a front 130. The back 128 includes a slot 132. The front 130 includes an elongate opening 134 and a staple receiving opening 136. A shuttle 140 is slidably received to slide within the body 120. A magazine handle 142 and spring 144 are connected to the shuttle 140 through the slot 132 in the back 128 of the body by conventional attachment such as a screw or rivet. The spring 144 is connected to the handle 142 at a non-coiled end.

The staple magazine 22 is connected to the top plate 20 for use. The top plate includes a pair of pivot mounts 150. The staple magazine also includes a pair of pivot mounts 152. The spring 144 is positioned between the mounts 152, and the mounts and the coiled end of the spring are axially aligned. A magazine pivot rod 154 is positioned through the axially aligned mounts and the coil end of the springs and shoulder screws are received in each end of the rod 154, in one embodiment. The magazine pivot rod 154 is utilized to connect the mounts thereby connecting the magazine assembly to the top plate 20, and providing a connection for the spring to tension the magazine, thus providing a downward force on the staples 16. The rod 154 allows for pivoting from a storage position to an operational position. It should be understood that the spring 144 could be attached to the tool or magazine elsewhere to provide the effective tensioning described herein. A magazine latch 160 is connected to the magazine body 120. The magazine assembly is moved to the operating position and the latch 160 is latched to the lip 162 of top plate 20. In this manner, the magazine assembly is secure in the upright, operational position.

The shuttle 140 is moved to the top of the body 120 for loading. The handle may be held by the user or latched to the top of the magazine for ease of use. A lip or latch 121 is utilized in one embodiment and is provided on handle 142. The lip 121 engages the top plate 122 of the magazine to hold it in a staple loading position. The number of staples 16 desired are placed in the body through the opening 136. The shuttle is then released allowing the shuttle to apply spring force to the staples making them ready to be loaded into the tool 10, on demand. As the handles 44 and 62 of the tool are fully opened, the advance slide 100 is moved by the cam 54 to the fully rearward position, allowing one staple 16 to index down to the platform on the base just in front of the advance slide. As the handles are rotated inward, the slide 100 forces one staple into the crimp pocket 42. The magazine utilizes the linear spring 144 to apply the correct consistent force on the staples in the magazine to insure correct loading into the tool from a full staple load to the last staple.

When the tool is ready for storage, the staples may be removed by moving the shuttle to the top plate 122 and removing the staples through the opening 136. The latch 160 may be released and the magazine is allowed to pivot downward to rest on the top plate 20 for storage.

Figure 12:
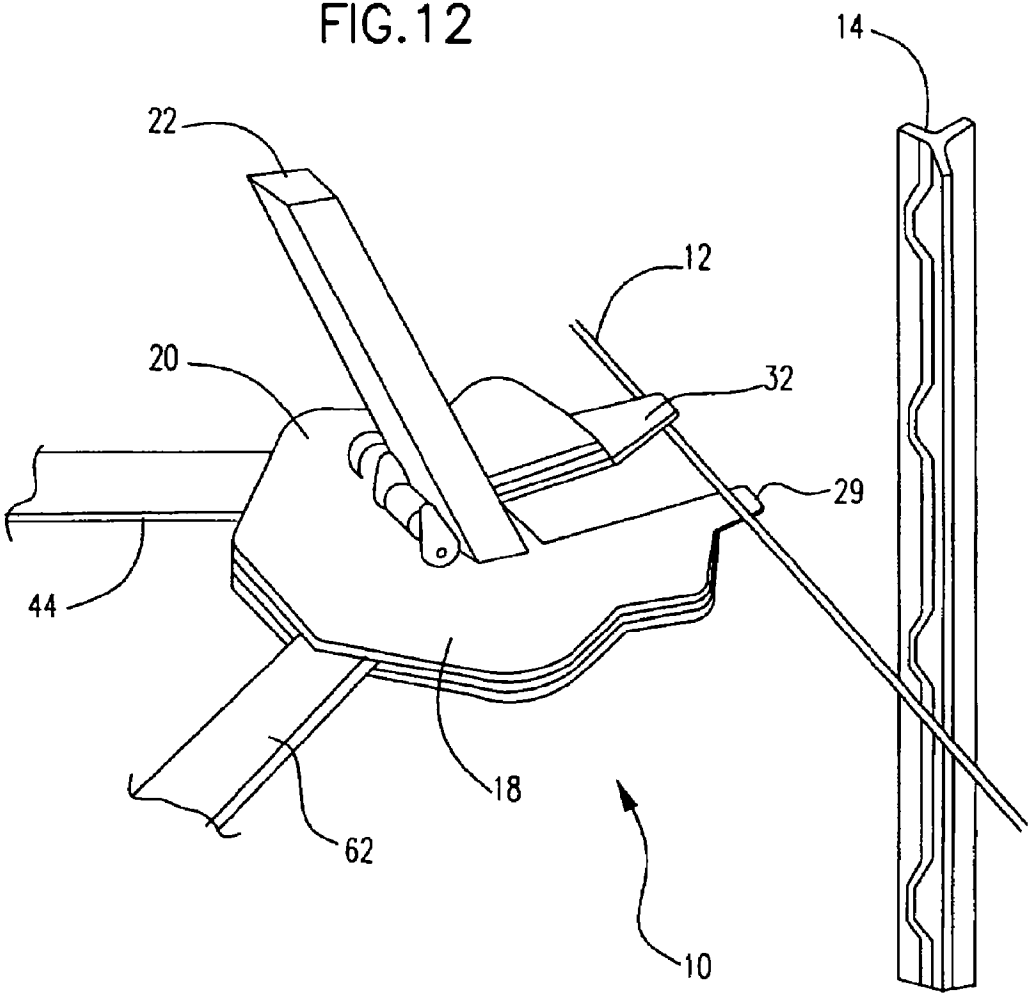
FIG. 12 is a perspective partial view of the embodiment as shown in FIG. 1 in an open position engaged with a wire to be attached to a fence post.
Figure 13:
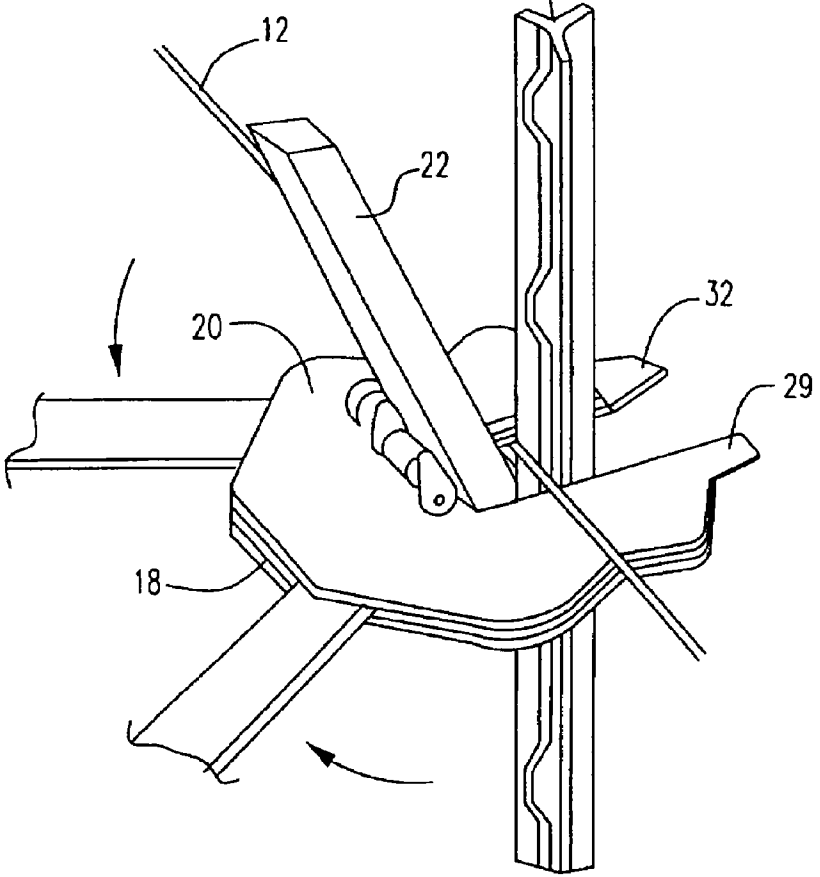
FIG. 13 is a perspective partial view of the embodiment as shown in FIG. 1 in a crimping position.
Figure 14:
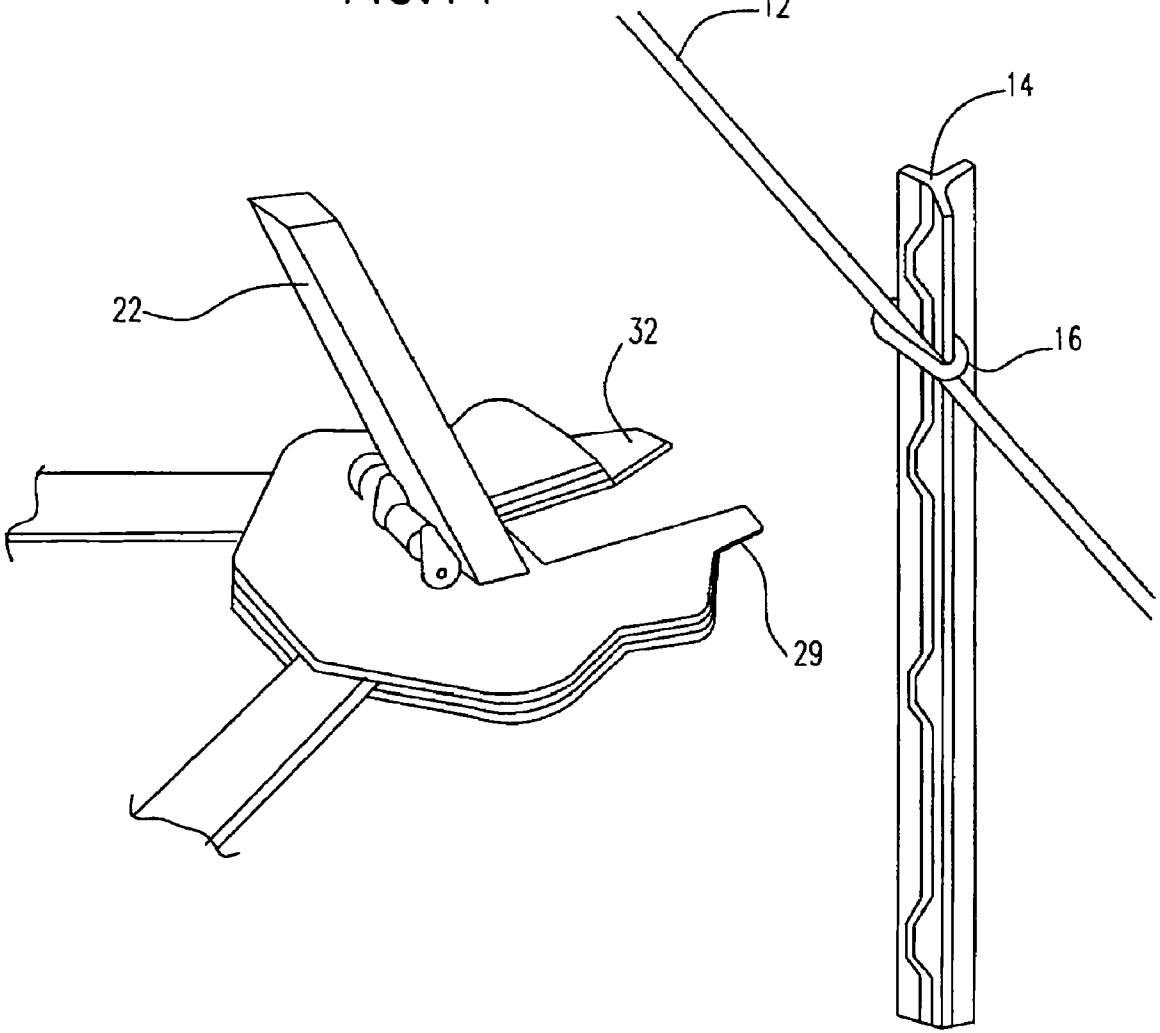
FIG. 14 is a perspective partial view of the embodiment as shown in FIG. 1 in an open position after the staple has been attached to the fence post.

In operation, the magazine is moved into position and the staples loaded as described above. With the first and second handles in the fully open position, the wire or fencing material to be attached is engaged by the first wire lift finger 29 and the second wire lift finger 32 as shown in FIG. 12. The wire is positioned over one of the lift fingers and positioned under the other lift finger. The tool 10 is then moved against the fence post by the operator at a desired position on the post as shown in FIG. 13. The handles are then rotated inward. As described above, the staple 16 is moved into the crimp pocket 42 and the crimp arms crimp the staple to the post as shown in FIG. 14. The handles are opened at this time to release the crimp arms from the staple and the post. The tool is now ready to begin a new cycle. The tool 10 is moved away from the post and the cycle is complete.

Figure 15:
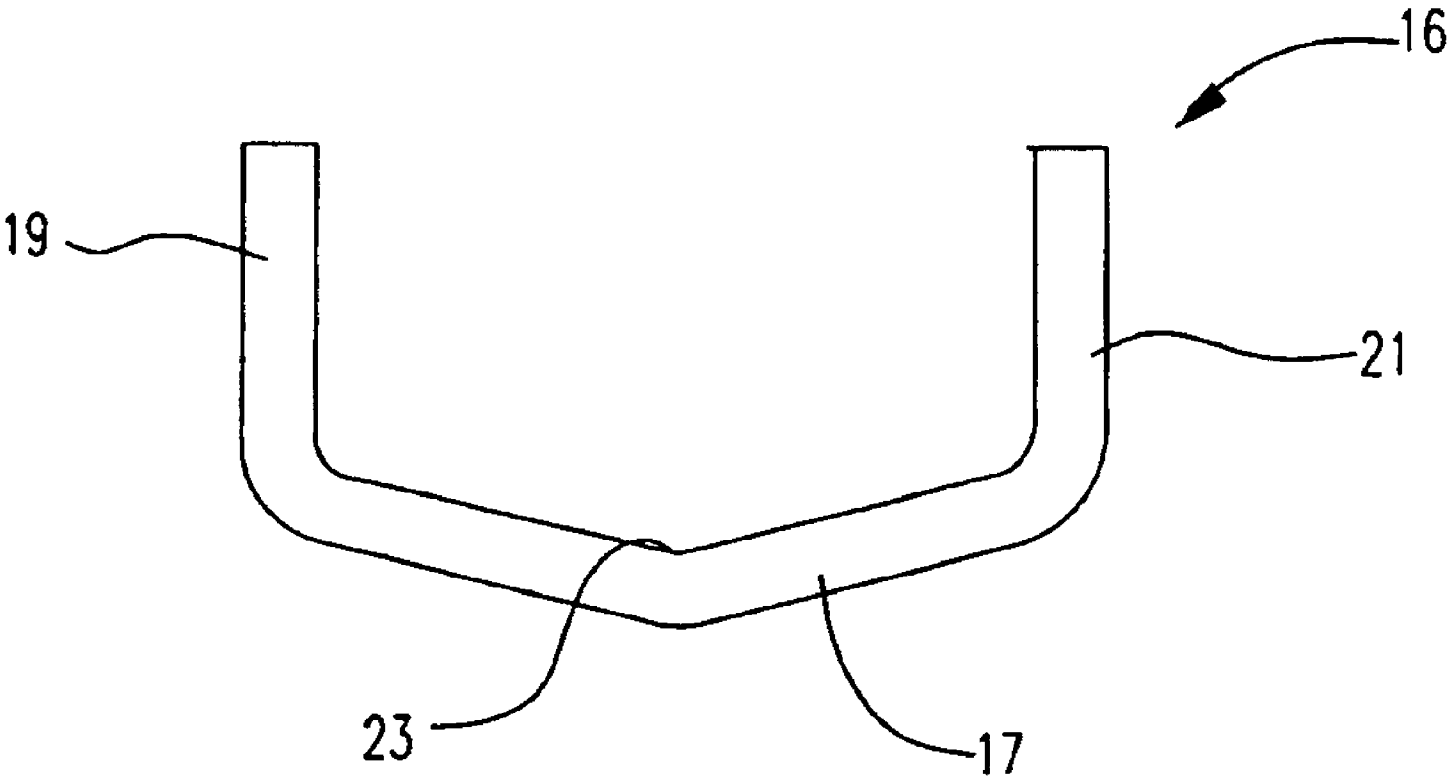
FIG. 15 is a top elevational view of an embodiment of the inventive staple.
Figure 16:
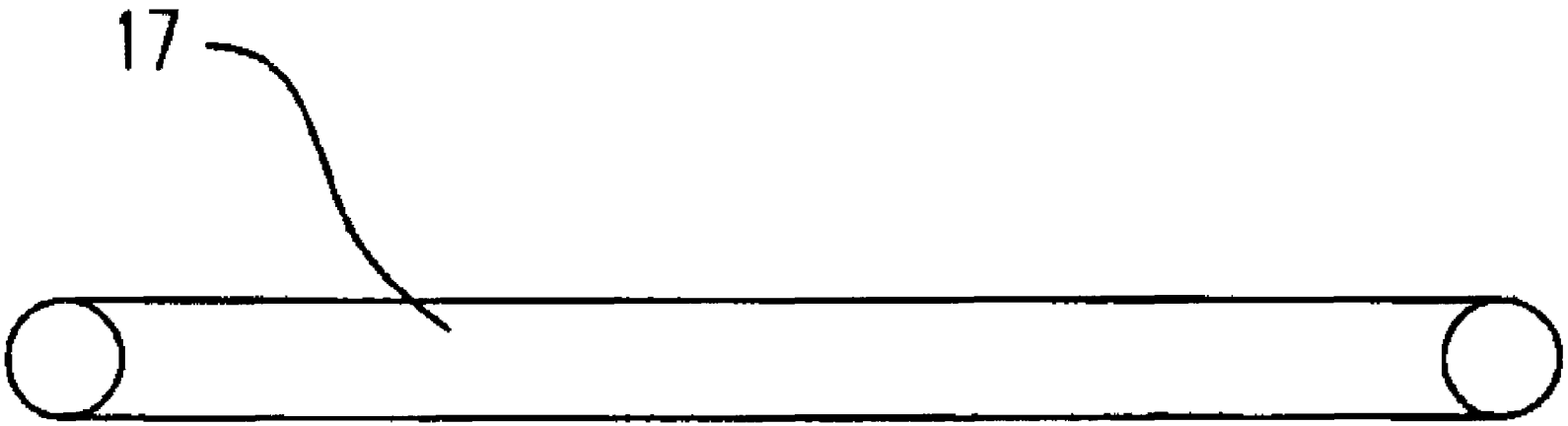
FIG. 16 is an end elevational view of an embodiment of the inventive staple.

The staple 16 is crimped to a post as described above in one embodiment. As shown in FIGS. 15 and 16, the staple 16 includes a base 17 and having a pair of legs 19 and 21. As described above, the staple is moved into position to contact the post and the staple is crimped onto the post, containing the wire, by forming the legs 19 and 21 of the staple around the back side of the wide side of the T-post. The crimping jaws 84 and 90 each contact an arm 19 or 21 of the staple 16 and force the arms inward and around the post. In one embodiment, the base of the staple includes a V-shape 23 to allow the wire to be securely crimped to a post while eliminating a point load that could cause a fence wire to fail at a low value. The V-shape also allows the fence wire to move laterally sharing loads to neighboring posts.

The staple is made of a heavy gauge wire in one embodiment and is generally circular in cross-section. It should be understood that the diameter of the wire may be varied for varying applications. Also, the cross-sectional shape of the staple may be of a variety of shapes including but not limited to round, oval, square or any other shape desired or required for a specific application. Further, the V-shape of the staple may not be required or desired in all applications.

It should be understood that the tool and application of fencing described above are not limited to the connection of one or more wires to a post. The tool works equally well with other types of material such as woven wire, metal snow fencing material, chain link fencing and non-metallic fencing. Non-metallic fencing includes but is not limited to safety barrier fencing, crowd control fence, snow fence, deer fence and barrier fence.

It should be understood that the tool and staple described herein may be used with a number of different materials in a number of different applications. The tool has been described in relation to fencing material and a T-post. However, a number of different applications include storage shelving, mechanical devices, or connection of two or more items. This may include brackets, straps, clips and other forms. The crimp jaws of the tool and the interface of the tool to the device may be varied to accommodate unique shapes and sizes of items to be attached and the form receiving the attachment. It should be understood that the fencing material may be plastic or metal.

It should be understood that the cam described in the embodiment shown could be connected or mounted to any of the moving elements of the tool or may be included as a separate driven element cooperatively engaged with the working parts of the tool.

It should be understood that the parts could be made of any commercially available material, such as steel, aluminum or plastics, or combinations thereof. In the embodiment discussed herein, the shuttle is preferably plastic and the other parts are steel.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A tool for fastening fencing material to a post with a staple, comprising:

a base plate;

first and second handles;

first and second crimping arms;

a cam operatively engaged with one of the handles;

a staple advance slide operatively engaged with the cam, the slide comprising a staple receiving end; and wherein the first and second handles and the first and second crimping arms are pivotally interconnected and are pivotally attached to the base plate.

2. The tool of claim 1 further comprising a top plate connected to the base plate, the top plate having a first wire positioning member.

3. The tool of claim 2 wherein the base plate includes a second wire positioning member.

4. The tool of claim 3 wherein the the first member and the second member are juxtapositioned to receive the fencing material between the first member and the second member.

5. The tool of claim 1 further comprising a recess for receiving the staple, the slide engaging a staple and advancing the staple into the recess as the cam linearly advances the slide;

a top plate connected to the base plate, the top plate having an aperture proximate the staple receiving end of the slide;

a chute constructed and arranged to receive at least one staple, the chute connected to the top plate and having a top portion and a bottom portion, the bottom portion having a chute aperture, the chute aperture generally aligned with the top plate aperture, wherein when the first and second handles are in an open position the staple is positioned onto the slide plate.

6. The tool of claim 5 wherein the top portion of the chute includes a staple clip receiving opening for receiving a clip of staples.

7. The tool of claim 5 wherein the staple delivery apparatus further comprises:

a shuttle configured and arranged to slide within the chute, the shuttle having a forward and a rear end, wherein the forward end of the shuttle engages the staple;

a spring having a first end and a second end, the first end connected to the chute and the second end connected to the shuttle, for applying a force to the staple to hold it in position.

8. The tool of claim 7 wherein the handles are rotated through a plurality of positions, from the open position to a fully open position, from the fully open position to a crimping position, from a crimping position to a closed position;

when the handles are in the fully open position, the slide is retracted behind the staple, the spring forcing the staple downward to the base plate;

when the handles are in the crimping position, the slide having advanced the staple into the recess, and when the handles are in the closed position, the crimping arms have crimped the staple to the post.

9. The tool of claim 8 further comprising a shuttle handle connected to the shuttle.

10. The tool of claim 1 wherein:

the first handle having a first set of gear teeth;

the second handle having a second set of gear teeth, the gear teeth of the first handle being cooperatively engaged with the gear teeth of the second handle;

the cam having a slot for engaging and linearly advancing the slide as the handle is pivotally rotated from an open position to a crimping position;

the slide having a slot engaging end having a pin received by the slot, the slide also having a staple receiving end, and a recess for receiving the staple, the slide engaging a staple and advancing the staple into the recess as the cam linearly advances the slide;

the first crimp arm having a third set of gear teeth, which cooperatively engage with the first gear teeth of the first handle, the first crimp arm being constructed and arranged for crimping a first side of the staple;

the second crimp arm having a fourth set of gear teeth, which cooperatively engage with the second gear teeth of the second handle, the second crimp arm being constructed and arranged for crimping a second side of the staple.

11. The tool of claim 1 wherein:

the first handle having a first set of gear teeth;

the second handle having a second set of gear teeth, the gear teeth of the first handle being cooperatively engaged with the gear teeth of the second handle;

the slide operatively engaged with the cam for linearly advancing the slide as the first handle is pivotally rotated from an open position to a crimping position;

the slide having a recess for receiving the staple, the slide engaging a staple and advancing the staple into the recess as the cam linearly advances the slide;

the first crimp arm having a third set of gear teeth, which cooperatively engage with the first gear teeth of the first handle, the first crimp arm being constructed and arranged for crimping a first side of the staple;

the second crimp arm having a fourth set of gear teeth, which cooperatively engage with the second gear teeth of the second handle, the second crimp arm being constructed and arranged for crimping a second side of the staple.

12. The tool of claim 1 further comprising means for positioning a staple adjacent the staple receiving end of the slide.

13. An apparatus, for fastening fencing material to a fence post, comprising:

a staple comprising a v-shaped base portion forming a vertex having an inwardly open angle and two legs extending from the base portion, each leg having a length, the base portion and the entire lengths of the legs lying in substantially the same plane, means for crimping the leg of the staple around the fence post to confine the fencing material between the base portion of the staple and fence post, and means for retaining the v-shape of the base portion when the legs of the staple are crimped around the fence post such the vertex formed by the v-shaped base portion provides a triangular-shaped confinement space for the fence material between the base portion and the fence post.

14. The apparatus of claim 13, wherein the means for crimping the staple comprises a tool, the tool comprising:

a base plate;

first and second handles;

first and second crimping arms;

a cam operatively engaged with one of the handles;

a staple advance slide operatively engaged with the cam; the slide comprising a staple receiving end; and wherein the first and second handles and the first and second crimping arms are pivotally interconnected and are pivotally attached to the base plate so that when the first and second handles are pivoted towards one another from an open position, the cam advances the slide, which advances the staple so that the crimping arms may crimp the staple to the fence post.

* * * * *